US006401401B1

(12) United States Patent
Williams

(10) Patent No.: US 6,401,401 B1
(45) Date of Patent: Jun. 11, 2002

(54) MULTI-COMPONENT FLASHING SYSTEMS

(76) Inventor: Mark F. Williams, 945 Tennis Ave. P.O. Box 859, Springhouse, PA (US) 19477

( * ) Notice: Subject to any disclaimer, the term of this patent is extended or adjusted under 35 U.S.C. 154(b) by 0 days.

(21) Appl. No.: 09/692,226

(22) Filed: Oct. 20, 2000

(51) Int. Cl.[7] ..... E04D 1/36; E06B 3/34

(52) U.S. Cl. ..... 52/58; 52/97; 52/302.6; 52/211; 49/471

(58) Field of Search ..... 52/58, 97, 204.1, 52/204.2, 211, 204.53, 302.6, 287.1, 741.3, 741.4; 49/471, 476.1, 506

(56) References Cited

U.S. PATENT DOCUMENTS

| | | | | | |
|---|---|---|---|---|---|
| 993,861 | A | | 5/1911 | McRonald | |
| 1,231,916 | A | * | 7/1917 | Landry | 52/58 |
| 1,677,130 | A | | 7/1928 | Cherry | |
| 4,555,882 | A | | 12/1985 | Moffitt et al. | |
| 4,700,512 | A | * | 10/1987 | Laska | 52/58 |
| 4,970,842 | A | * | 11/1990 | Kappeler et al. | 52/741.3 |
| 5,018,333 | A | * | 5/1991 | Bruhm | 52/60 X |
| 5,210,986 | A | * | 5/1993 | Hagemeyer et al. | 52/211 |
| 5,542,217 | A | * | 8/1996 | Larivee, Jr. | 49/471 |
| 5,899,026 | A | | 5/1999 | Williams et al. | |
| 5,924,259 | A | * | 7/1999 | Marousek | 52/656.1 |
| 6,098,343 | A | * | 8/2000 | Brown et al. | 52/58 X |
| 6,305,130 | B1 | * | 10/2001 | Ackerman, Jr. | 52/58 |
| 6,305,132 | B1 | * | 10/2001 | Smith | 52/204.1 |

OTHER PUBLICATIONS

Hyload Damp–Proof Course System Data Sheet (2) dtd. Mar. 1982.

* cited by examiner

*Primary Examiner*—Carl D. Friedman
*Assistant Examiner*—Winnie Yip
(74) *Attorney, Agent, or Firm*—Cornellius J. Husar, Esq.

(57) ABSTRACT

The invention relates to an improved multi-component flashing system for controlling water and air that intrudes at windows, doors, louvers and other wall penetrations. It accomplishes this through the use of several known commercially available products which are applied to the areas to be protected in a unique manner thus saving time and providing a heretofore unknown measure of protection. The first product is an elastomeric adhesive sealant which readily bonds to most building materials as well as the components of this system. The second product is a clay coated polyethylene film which can be folded, cut and shaped to fit various opening conditions. A third, optional component, is a uniquely designed preformed flexible termination accessory which also readily bonds to the clay coated film material through the use of the elastomeric adhesive sealant. The clay coated film material is readily available in roll form and can readily be hand cut to the dimensions of the particular job. In some instances, the flashing will be completed through the use of the coated polyethylene sheet flashing in combination with the elastomeric rubber adhesive sealant. Optionally, termination accessories may be used in combination with the coated polyethylene sheet flashing material, and the elastomeric adhesive sealant. The termination accessory has been specially designed to allow the same unit to be used in opposite corners of an area to be protected, thus reducing the types of units required on a single job by fifty percent.

19 Claims, 6 Drawing Sheets

MULTI-COMPONENT FLASHING SYSTEMS

BACKGROUND OF THE INVENTION

The subject invention relates to environmental protection for residential or commercial construction, more specifically, a means to control water and air that intrudes at windows and doors or other exterior wall components. Historically, flashing is the term used to identify the means or components utilized to prevent water intrusion. In the subject invention, the flashing can be used to control water intrusion and air intrusion depending upon the option chosen.

In recent years, many attempts have been made to find a solution to this ever present problem of water and air intrusion. Controlling water and air intrusion is a very serious concern which may result in exterior and interior damage if not prevented or corrected in a timely manner. Recent studies have shown that the extent of such damage, on an annual basis, has run into millions of dollars. In addition, heat looses through air leakage around window, door and louver openings have taken on new significance due to today's high energy costs. It has become imperative that a more serious approach be taken to control water and air intrusion to reduce heating costs in the country, especially in the North Eastern U.S. and our Canadian friends to the north of us.

In the past, one method for dealing with the potential for water intrusion was to expect that some water will enter around or through exterior wall components and to provide a means to collect and control the water. This objective was accomplished with preformed metal pieces within the wall construction, to protect the underlying material from damage.

Alternatively, a surface sealed approach has been used. Putty-like components were used to caulk around openings between the window and door frames to seal the gaps and prevent inward seepage of water and air into the building. However, after a period of time, the putty-like compounds had a tendency to dry up, shrink and produce gaps or openings thus providing a passageway for water and air to penetrate the building enclosure ultimately resulting in deterioration beneath the window and door frames at the sheathing or structural components adjacent thereto. The minor amounts of air leakage was considered acceptable due to an abundance of relatively cheap fuel prices.

In an effort to overcome the inadequacies inherent with caulking, advances in chemical field have produced new sealant materials which are better equipped to withstand the sun, temperature variations and exposure to the elements for a longer period of time. Nevertheless, these improved sealants eventually break down or were not initially installed properly and water and air intrusion occur. It is clear that something more than sealants is desirable and new flashing materials and techniques are needed to provide long-term protection against water and air intrusion.

DESCRIPTION OF THE PRIOR ART

As indicated above, many attempts, in a variety of forms, have been tried over the years to provide a permanent solution to the above-outlined problem. For example, U.S. Pat. No. 993,861, issued to McRonald, made an early attempt to waterproof a window frame or casing by installing a window pan adapted to be placed beneath the vertical and horizontal members of a window casing. The window pan was made of sheet metal with a trough-like formation disposed beneath the horizontal and vertical members of a window casing to discharge any rain or condensation exteriorly of the building.

Subsequently, U.S. Pat. No. 1,677,130, issued to Cherry, made another attempt to solve the problem which still existed some seventeen years later. Cherry utilized a flashing for installation beneath the angled sill of a window which was comprised of a plurality of sections having corrugations thereon to define troughs for conveying moisture from any point of the interior to a position exterior of the outermost construction material.

More recently, U.S. Pat. No. 4,555,882 issued to Moffit et al, discloses an integrally formed rigid plastic moisture guard having a base, front edge, rear wall and end wall adapted to be placed beneath a window sill or door frame to direct moisture to the exterior of the building. In this device two separate, distinct moisture guards are required, one for each side of the framed window or door opening. An extension member is required to be placed beneath the abutting center line edges of the moisture guards to seal therebetween. A suitable adhesive such as ABS cement is required to hold the components together.

Another non-patent publication of interest is the Hyload Damp-Proof Course System Data Sheet dated March 1982. It discloses a pre-formed cloak for use in brick, block, stonework or concrete walls of both solid and cavity construction in horizontal, vertical or stepped positions including cavity trays. Although there is some similarity in appearance, there is no disclosure as to its use as a flashing component relative to a window or door flashing system as in the instant application.

The most recent known prior art in U.S. Pat. No. 5,899,026 issued to Williams et al. This patent relates to a multi-component elastomeric material as its flashing system. It comprises a liquid form of elastomeric silicone material which is self-levelling and readily adheres to wood and most known building materials. This system is a multi-step process wherein the area to be protected is first coated with a specially formulated elastomeric material to fill all voids and cracks and waterproof the opening framing members which will support the window when placed therein. After curing of the elastomeric coating, a solid form of flexible elastomeric material with a flexible encapsulated substrate therein is shaped by hand to custom fit the needs of the particular job, and may be used to supplement the previously applied elastomeric coating. This patent, which was co-invented by the applicant of the present invention, has been found to contain certain deficiencies.

Accordingly, applicant has developed these systems, as clearly set forth hereinafter, to overcome the deficiencies of the prior art noted above.

SUMMARY OF THE INVENTION

The present invention overcomes the deficiencies of the prior art by providing three different systems for protection against air and water intrusion, or water instruction only. In the first system, which specifically addresses water intrusion concerns, an initial layer of coated polyethylene sheet flashing (CPSF) is placed across the horizontal sill plate of the window opening. This layer is hand cut to the dimensions of the rough opening of the sill plate with vertical overlap on the side jambs and a downward overlap of the exterior sheeting and a rear upward extension for the full width of the opening. After placement of this sill piece of CPSF, a coating of elastomeric adhesive sealant is applied to the jamb/sill corner areas followed by placement of a termination accessory in each of the corners. After stapling the upper legs of each termination accessory, a further coating of elastomeric adhesive sealant is applied to edges of the termination accessories. In instances where additional reinforcement is necessary, fiberglass reinforcing mesh with an adhesive coating on one side is layered over those areas followed by an additional coating of elastomeric adhesive sealant. The preformed termination accessory installation is now completed at the rough opening. This final installation easily interfaces with other construction materials to control water intrusion.

The second system addresses both water and air intrusion concerns. The installation begins with an initial layer of CPSF installed on the sill plate in the manner as set forth above. However, this is followed by a second and third piece of coated flashing material applied to the left and right jambs of the opening with several inches of overlap on the sill and header portions, followed by a fourth piece placed across the header rough opening with several inches of overlap on the jamb portions. Each of the CPSF pieces includes an upstanding inwardly turned portion which will be sealed against the window/door/louver framing after installation, to control water and air infiltration. Further securement of the CPSF may be accomplished by stapling at limited locations, and further water and air protection is accomplished by coating the overlapping surfaces and edges of the CPSF with the elastomeric adhesive sealant. The elastomeric adhesive sealant may also be used to adhere the CPSF pieces to most typical building materials and components.

In some instances, where the use of a preformed corner piece is desired to simplify the installation, a third system may optionally be utilized. The third system addresses both water and air intrusion concerns. In this system the procedure is similar to a combination of the first two systems, i.e. a piece of CPSF is first installation on the sill rough opening in the manner previously set forth, followed by installation of the preformed corner termination accessories which are made of a high performance elastomeric material, followed by installing the left and right jamb pieces with an overlap of the upper edges of the termination accessories and completed by installing the header CPSF piece, installed as previously set forth.

The preformed termination accessories has been specially designed to allow a single unit to be used at both the left and right hand sides of the rough opening. This feature is considered to be a significant advance over the prior art wherein two differently configured units were previously required, i.e. one for the left-hand corner and another for the right-hand corner to satisfy the requirements.

OBJECTS OF THE INVENTION

An object of the invention is to provide an improved flashing system which overcomes the deficiencies of the prior art.

Another object of the invention is to provide a flashing system which utilizes commercially available materials of recent technological development.

Still another object of the invention is to provide at least portions of an opening with a coating of elastomeric adhesive sealant followed with four pieces of coated polyethylene sheet flashing applied in overlapping fashion to conform to the opening dimensions, with or without the termination accessory.

A further object of the invention is to provide a flashing system wherein a flexible coated cross-laminated polyethylene sheet film is utilized as the initial layer to protect the sill opening against water and air intrusion and provide a base for the subsequently added elastomeric adhesive sealant and preformed termination accessories.

Yet another object of the invention is to provide a unique preformed flexible termination accessory, made of high performance elastomeric material, which can be utilized in both corners where the vertical oppositely disposed side stud members meet the horizontal sill plate.

Another object of the invention is to provide a method including a series of steps which combine to provide a flashing system which is far superior to all known prior art systems; and can easily be used in conjunction with other standard construction materials and techniques to control water and air intrusion.

These and other objects of the invention will become more readily apparent upon further review of the following specification and drawings.

BRIEF DESCRIPTION OF THE DRAWINGS

Various other objects, features and attendant advantages will become more fully appreciated as the same becomes better understood when considered in conjunction with the accompanying drawings, in which the reference characters designate the same or similar parts or components in the several views (all views are from the building exterior), and wherein.

DETAILED DESCRIPTION OF THE PREFERRED EMBODIMENTS

Figure 1:
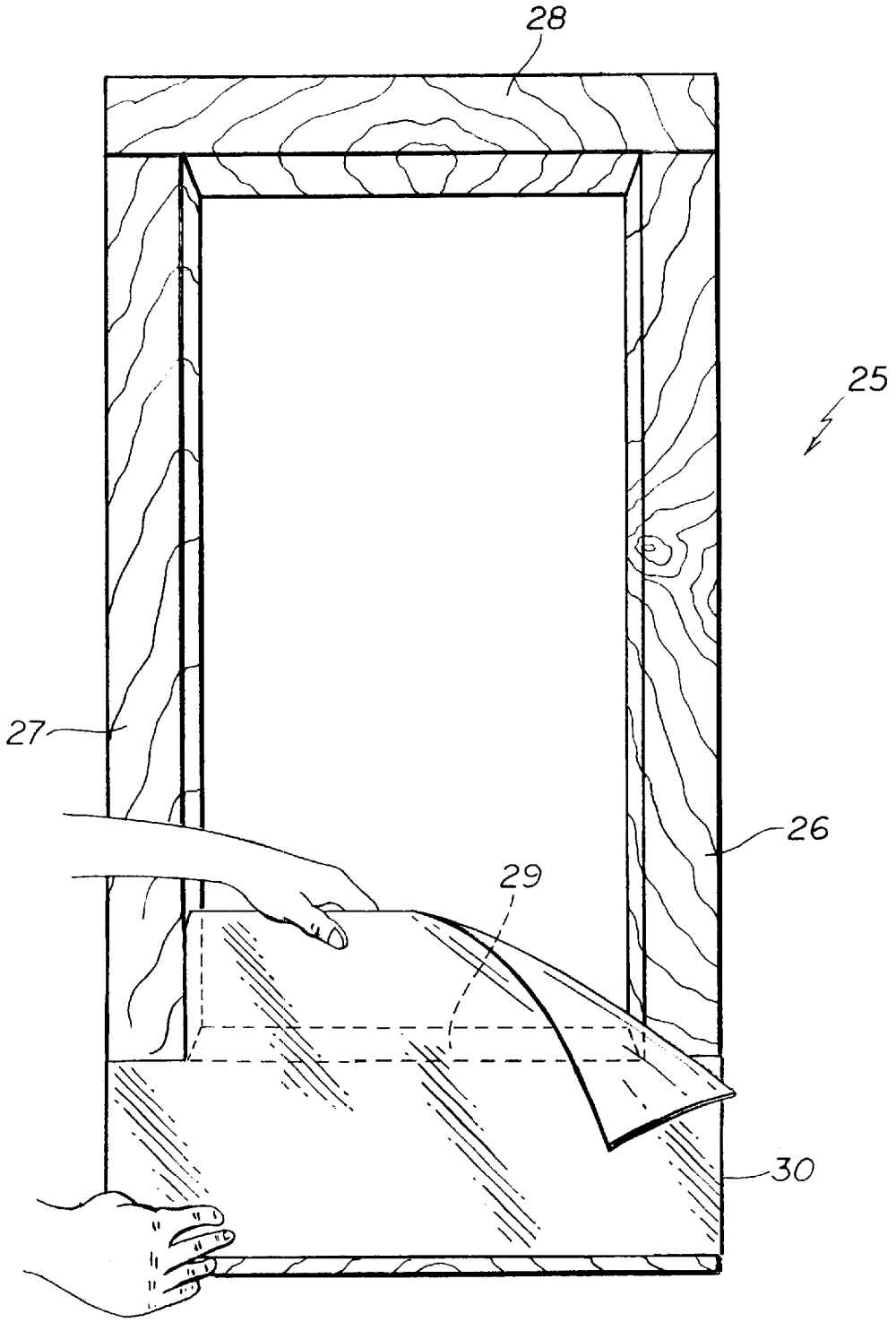
FIG. 1 is an illustration of a rough opening for a window with the coated polyethylene sheet flashing (CPSF) being positioned in the opening.

Referring now to FIG. 1, there is shown a roughed-in window opening 25 comprised of a pair of spaced vertically positioned studs 26, 27 a header 28 and a sill support 29, which is obscured by a piece of coated polyethylene sheet flashing material 30 (CPSF) which has been hand cut to the approximate dimensions of the window sill area with sufficient overlap to insure proper sealing of the window sill area to be protected, especially at the intersection of vertical studs 26 and 27 with horizontal sill support member 29. As indicated above, one commercially available product is VALERON®, a product of Valeron Strength Films, an ITW Company, a cross-laminated polyethylene sheet film product readily available on the open market.

This sheet film material 30 is made by cross-laminating of the layers to give added strengthening in all directions. Additionally, this product can be manufactured to include a clay coating on one or both sides. It has been found that the clay coating provides an excellent adherent characteristic or quality to the polyethylene sheet film and readily bonds with another commercially available elastomeric coating product. One example of such product is known as GE Silicone Rubber Adhesive Sealant RTV 110. The attributes and cooperative features of these two components will be discussed in greater detail after a discussion of the various figures of the drawings.

As can be seen in FIG. 1, a piece of polyethylene film 30 has been cut to the approximate dimensions of the window opening with sufficient overlap in the required areas. Piece 30 has been cut in-situ from a roll of CPSF by hand with a pair of scissors to the rough dimensions shown.

Figure 2:
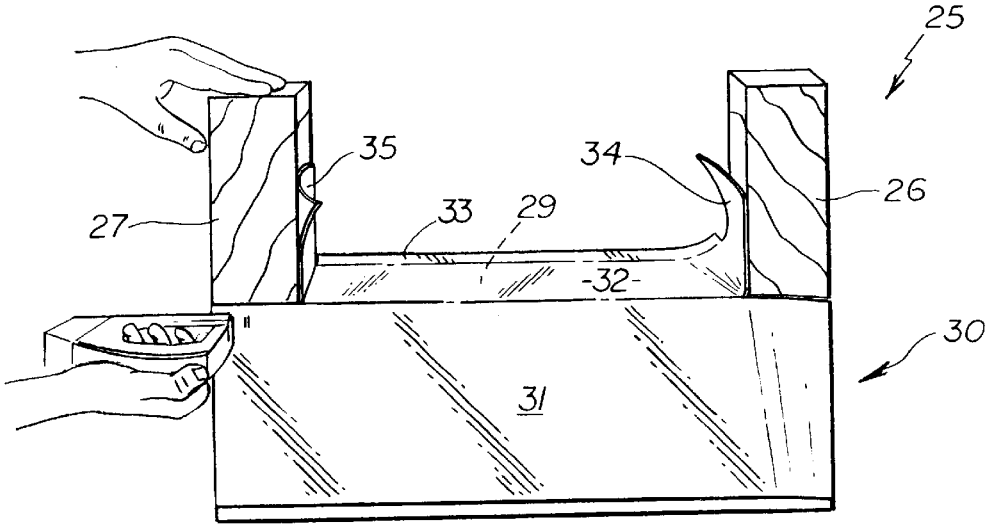
FIG. 2 is an illustration of the CPSF placed over the sill plate with the left an right vertical legs about to be stapled in place.

FIG. 2 illustrates the placement of the roughly cut polyethylene base sheet 30 (CPSF) having a front planar portion 31 which overlies the exterior sheathing, a rearwardly extending portion 32, overlapping sill support member 29, an upwardly turned rearmost portion 33, and a pair of vertically extending leg portions 34 and 35 for placement over the inside faces of vertical stud members 26 and 27, respectively. After polyethylene sheet 30 has been positioned and smoothed, it is further secured in place by stapling, at limited locations.

The next step is to apply a coating of the elastomeric adhesive sealant 36 to limited areas where the novel termination accessories are to be located.

Figure 3:
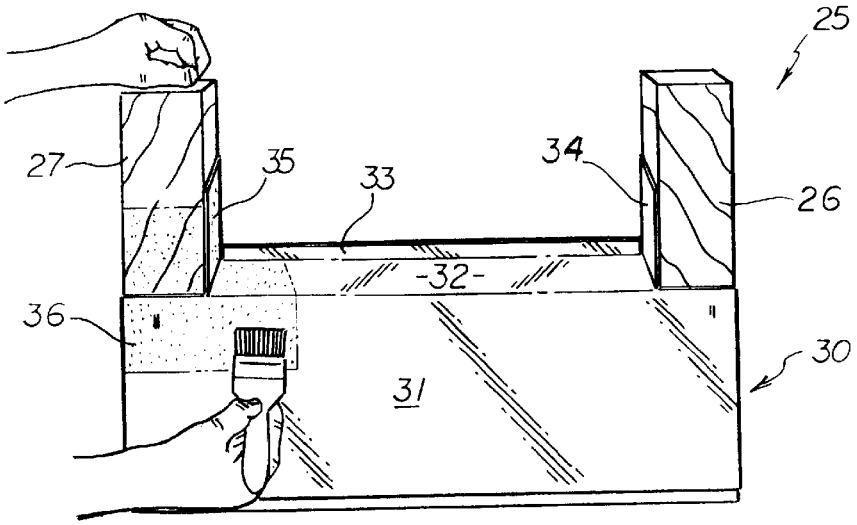
FIG. 3 is an illustration of the manual application of the elastomeric adhesive sealant being applied to the areas where the preformed termination accessories will be located.

FIG. 3 is an illustration of rough window opening 25 with polyethylene base sheet 30 stapled in position with the elastomeric adhesive sealant 36 being manually applied by brush. As indicated in FIG. 3, elastomeric adhesive sealant 36 is applied to portions of the left and right corner areas of window opening 25 in preparation for insertion for termination accessories 40. Elastomeric adhesive sealant 36 may be applied over polyethylene base sheet 30 as well as exposed areas of vertical stud members 26 and 27 where termination accessories 40 will be located. The elastomeric adhesive sealant 36 is a self-levelling material which readily bonds to most building construction material including wood and metal studs, wood and gypsum sheathing products, masonry, termination accessories 40, as well as polyethylene base sheet 30 (CPSF) which has a clay coating on at least its outer surface and in certain instances, both sides will have a clay coating thereon.

Figure 4:
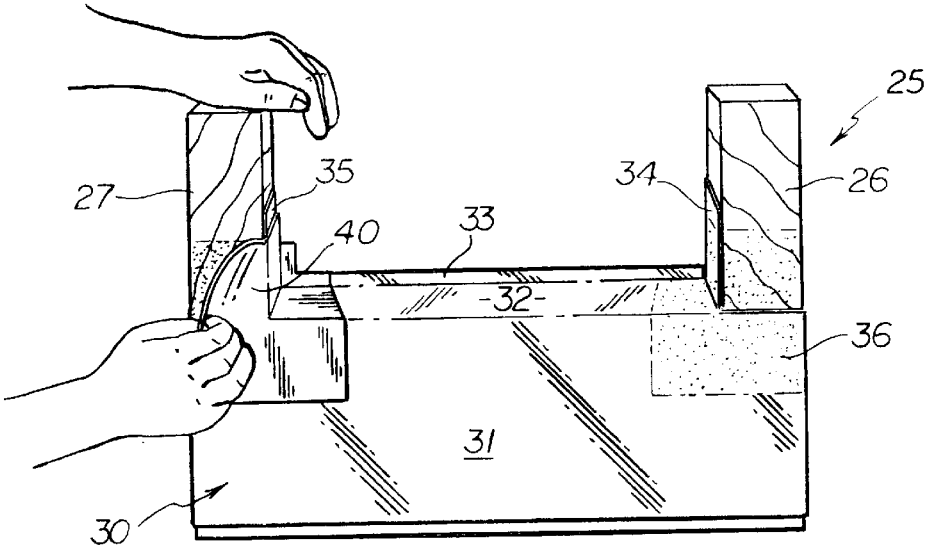
FIG. 4 is an illustration of the installation of the left preformed termination accessory installed in the left-hand corner of the window opening.

FIG. 4 illustrates the placing of termination accessory 40 in the lower left-hand corner of rough window opening 25. The right side of rough window opening 25 is shown with elastomeric adhesive coating 36 applied in preparation for termination accessory 40.

Figure 5:
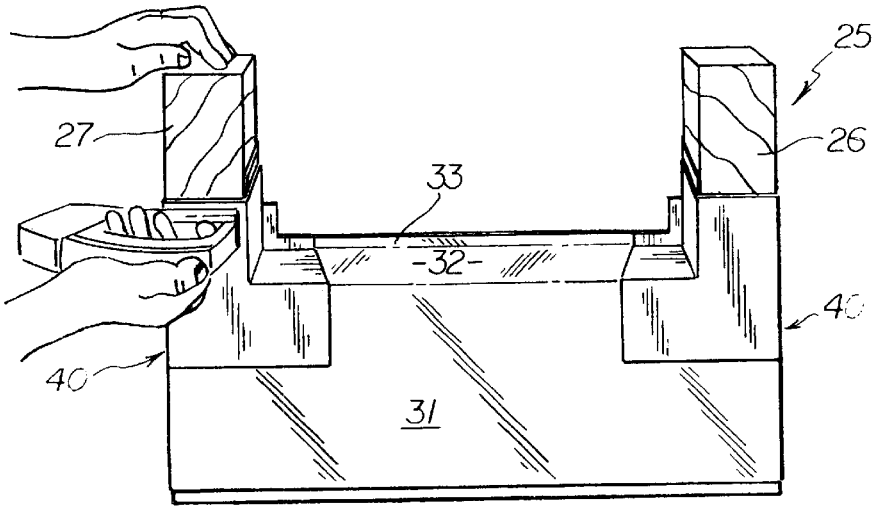
FIG. 5 is an illustration of both preformed termination accessories in place undergoing stapling of the legs.

FIG. 5 shows rough window opening 25 with both termination accessories 40 in place and stapling at limited locations for added securement.

Figure 6:
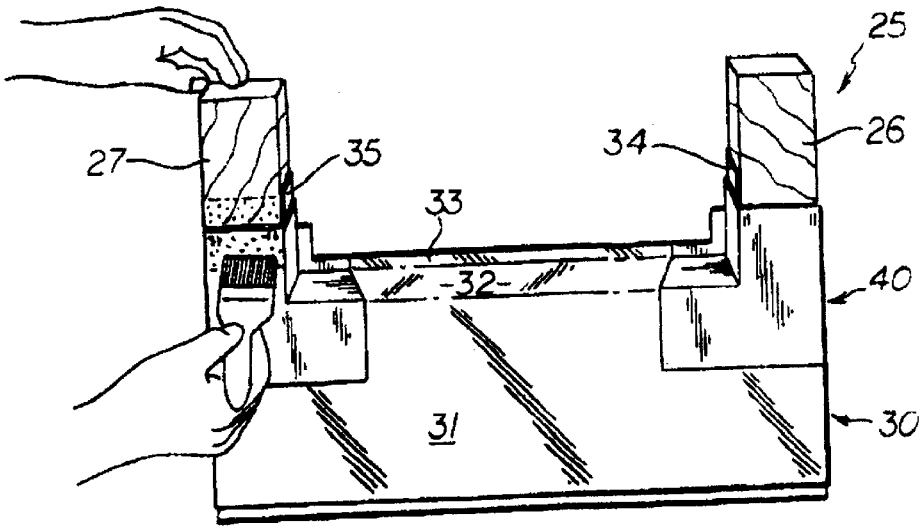
FIG. 6 is an illustration of the final step of the installation process wherein a final coating of the elastomeric adhesive sealant is applied manually.

FIG. 6 is an illustration of the final step of the procedure for providing protection against water intrusion to rough window opening 25. As illustrated, an additional coating of elastomeric adhesive sealant 36 is applied over portions of termination accessories 40 that have been installed. In this step, special emphasis is placed on the exposed edges of both termination accessories 40 to control water intrusion at these locations.

Figure 7:
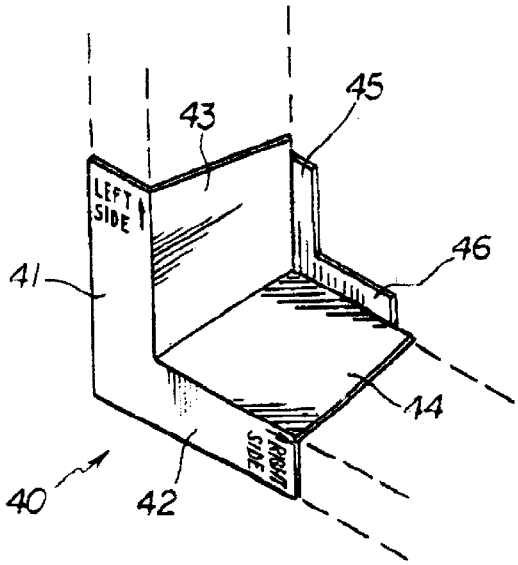
FIG. 7 is an illustration of the novel flexible termination accessory which is utilized in both corners of the rough opening showing its orientation for left-hand corner use.

Turning now to FIG. 7, there is an illustration of termination accessory 40 showing its approximate positioning for a left-hand corner insertion. Termination accessory 40 is a pre-molded unit made of high performance elastomeric material which remains flexible after molding. As illustrated, termination accessory 40 includes a pair of frontal legs 41 and 42, one vertical and one horizontal, with a pair of integral rearwardly extending legs 43 and 44 at right angles to their respective leg connections 41 and 42, followed by a third pair of legs 45 and 46 which are connected to legs 43 and 44, respectively, and extending perpendicularly thereto. As seen, termination accessory units 40 extend for only a portion of sill support area 29 since the primary area of water penetration is at the corners. However, any water which collects in the area between the two placed termination accessories 40 will be prevented from entering the building by vertically extending upward turned portion 33 of coated polyethylene base sheet 30. Portion 33 also serves as a barrier to air intrusion when sealed to the window/door/louver framing.

Figure 8:
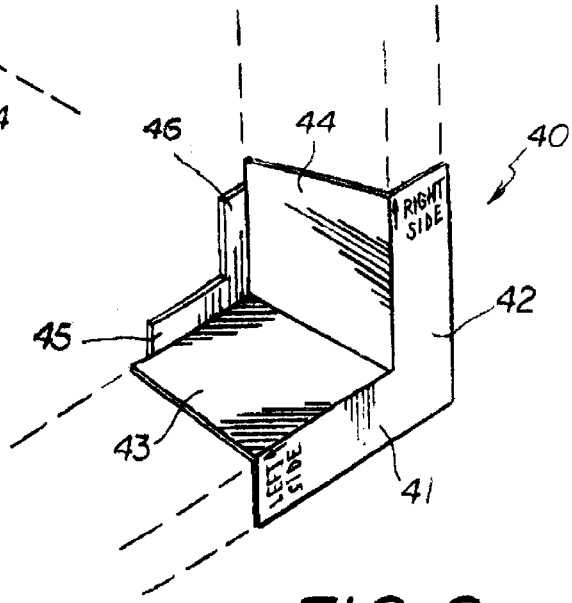
FIG. 8 is an illustration of the novel flexible termination accessory which is utilized in both corners of the rough opening showing its orientation for right-hand corner use.

FIG. 8 is another view of termination accessory 40, however, it has been rotated counter-clockwise ninety degrees to allow for a right-hand installation in rough window opening 25. As pointed out earlier, termination accessory 40 has been uniquely designed and dimensioned to permit the same accessory unit to be used in either corner of the rough window opening 25. This unique design allows its use in either corner whereas prior art end dam units required two different units, i.e. one specifically designed for the left side and another specifically designed unit for the right side with an underlying member placed beneath the horizontal mid-point where both the left and right elements abutted each other. Thus, applicant has reduced the number of component accessory units by fifth percent, a goal which is always sought in the construction industry.

Figure 9:
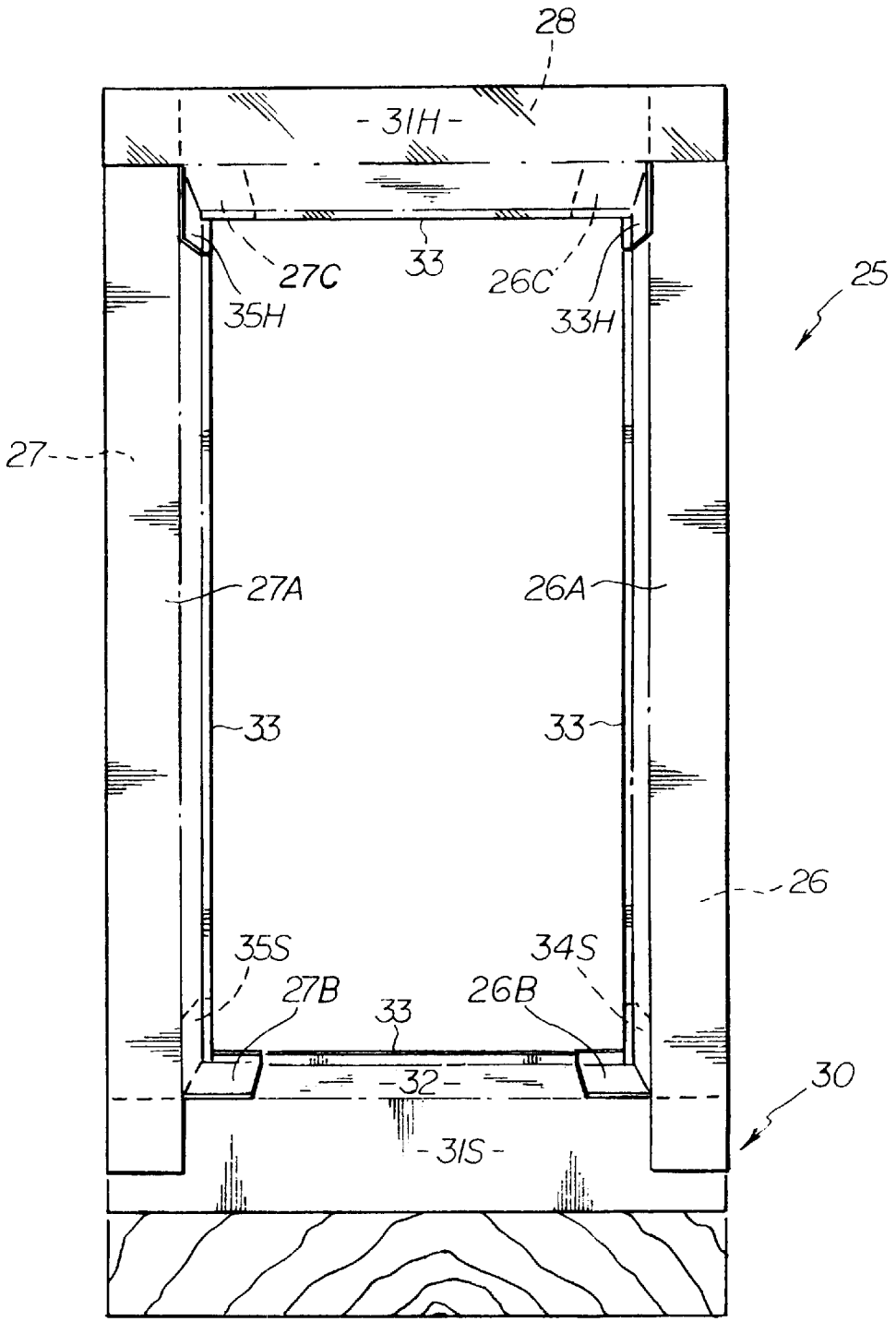
FIG. 9 is an illustration of the embodiment wherein the rough opening is covered with four pieces of coated polyethylene sheet flashing material.

Referring now to FIG. 9, there is illustrated the embodiment wherein termination accessory 40 is not used. However, in this embodiment all four sides of the rough window opening are covered with the coated polyethylene sheet flashing material. First, a piece of coated polyethylene sheet flashing material 31S is cut and placed over the sill area with upwardly turned portions 34S and 35S extending up the jambs for a short distance. Next, left and right jamb pieces 27A and 26A are installed with overlapping portions 26B, 27B and 26C, 27C extending over sill portion 31S and header 28, respectively. The next step in this instance, is the installation of header piece 31H with downwardly turned portions 34H and 35H overlapping jamb pieces 26A and 27A, respectively. Finally, overlapping areas may be coated and joined with elastomeric adhesive sealant 36 As pointed out above, this is an optional manner of completing the flashing of rough opening 25.

Figure 10:
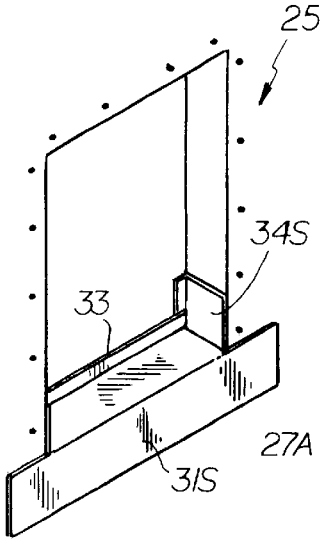
FIGS. 10–12 illustrate the sequence of steps followed in the placement of the CPSF in the instance where the termination accessory units are not utilized. It is a step-by-step illustration of the sequence followed to produce the CPSF installation illustrated in FIG. 9.
Figure 11:
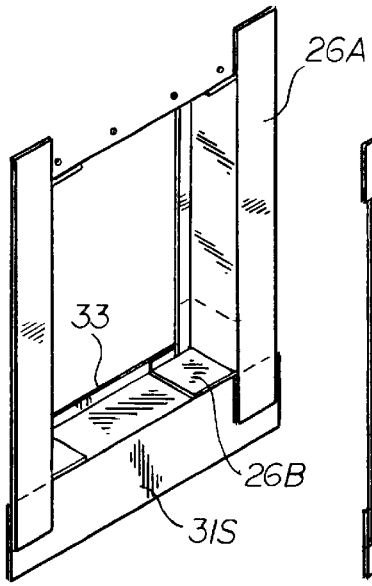
Figure 12:
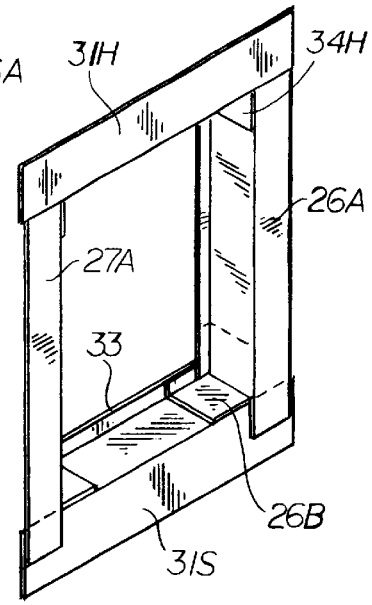

Referring now to FIGS. 10–12, there is illustrated the sequence in which the flashing of FIG. 9 is accomplished. Firstly, a piece of CPSF material 31S is hand cut to the approximate dimensions of the sill area of the opening. As indicated earlier, CPSF is readily foldable and creaseable, piece 31S is placed on the sill with a frontal overlapping portion and two upwardly turned pieces 34S, 35S, with only 34S shown in this view due to its angle.

Turning now to FIG. 11, there is shown right jamb piece 26A with a sill overlapping portion 26B, and header overlapping portion 27B not visible in this view. After placement of right jamb piece 26A, left jamb piece 27A is applied in the same manner, followed by header piece 31H which is shown in completed view FIG. 12. As can be seen from these views, rough window opening 25 has been completely and effectively covered in preparation for insertion of a window. All four corners are provided with dual layers of CPSF and since both sides of the CPSF are clay coated, an optional application of elastomeric adhesive sealant in these areas effectively bonds and seals both layers of CPSF forming an effective seal thereat.

Figure 13:
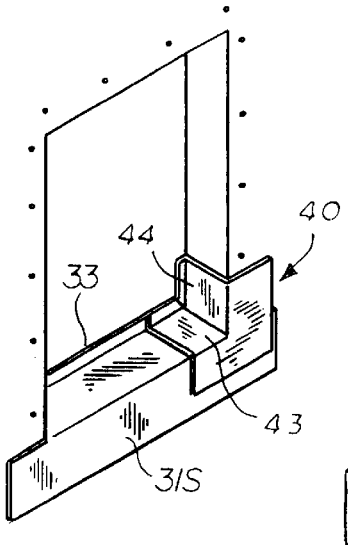
FIGS. 13–15 illustrate the sequence of steps followed in the placement of the CPSF pieces in the instance where termination accessory units are installed in addition to the four CPSF pieces.
Figure 14:
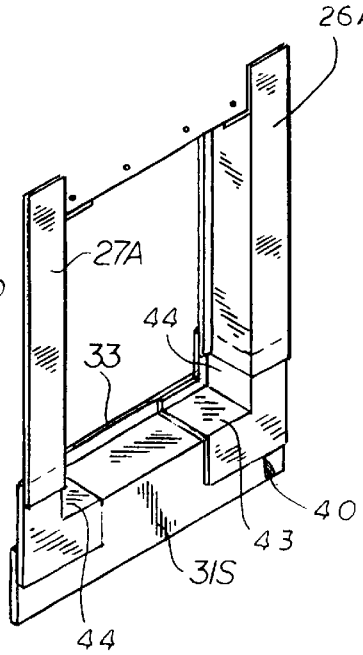
Figure 15:
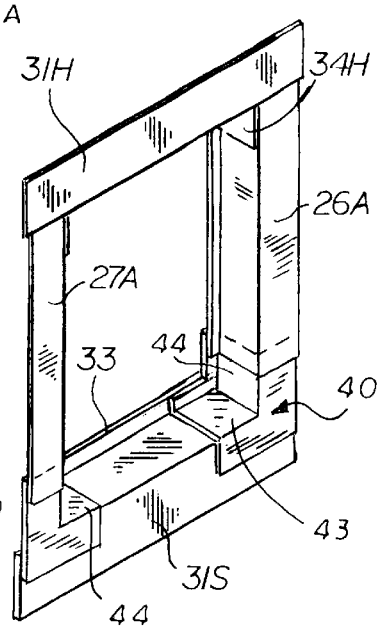

Referring now to FIGS. 13–15, there is illustrated the procedure taken when the optional termination accessories are utilized in both lower corners of rough opening 25. In this situation, CPSF piece 31S is installed first in the same manner as previously described, followed by an application of elastomeric adhesive sealant in both corners where termination accessories 40 are to be installed. Next, termination accessories are placed in their respective corners with a slight application of finger pressure to insure good contact with the elastomeric adhesive sealant. Next, jamb pieces 26A and 27A are installed as before, however, their lowermost ends overlap and extend only to the midpoint of upwardly extending portions 43 and 44 of termination accessories 40. In this manner, any water flowing down jamb pieces 26A and 27A will be prevented from entering behind the uppermost edges of termination accessories 40 due to the overlap and uninterrupted downward flow, permitting the water to exit at the sill area.

FIG. 14 illustrates both termination accessories 40 in place with jamb pieces 26A and 27A in place. As shown, there is an overlapping of termination accessories 40 by the lowermost ends of jamb pieces 26A and 27A sufficient to extend over the top edges of termination accessories 40 to prevent entry of water at that location. FIG. 15 is an illustration of the flashing of rough opening 25 with header piece 31H in place overlapping both jamb pieces 26A and 27A as shown at 34H and 35H.

As can be seen from the foregoing figures and their descriptions, there has been set forth several embodiments and options available to a builder, whereby one may select the most desirable system to suit his particular needs and provide a complete flashing system in a minimum amount of time by using products readily available on the open market at minimum costs to the consumer.

While the invention has been described in its preferred embodiments, it is to be understood that the words which have been used are words of description rather than limitation and that changes may be made within the purview of the appended claims without departing from the full scope or spirit of the invention.

Having thus described my invention, I claim:

1. A flashing system for preventing intrusion of water and air at windows, doors and other through wall penetrations comprising:

through wall rough opening means in a building structure comprised of a pair of spaced vertical stud members and a horizontal base member interconnecting said vertical stud members forming a pair of opposing rough opening base corner areas to be protected against water intrusion and an optional exterior sheathing board layer attached to said stud members;

a sheet of clay coated polyethylene sheet flashing material hand cut to the approximate dimensions of said through wall rough opening area to be protected with a rear upstanding portion extending the full width of said through wall rough opening and secured thereon with a clay coating on at least one side of said coated polyethylene sheet flashing material facing outwardly and secured thereto by attachment means comprising an elastomeric adhesive sealant;

a coating of elastic adhesive sealant applied to the outer surface of said clay coated polyethylene sheet flashing material in said opposing corner where said vertical stud members and said horizontal base member intersect since these are the most likely areas of water intrusion; and preformed termination accessory means installed in each of said opposing rough opening base corners over said elastomeric adhesive sealant followed by another coating of said elastomeric adhesive sealant whereby said sheet flashing material, said elastomeric adhesive sealant and said preformed termination accessory all readily bond to each other to provide weather resistive protection at the opening in preparation for subsequent installation of a through wall closure member and said installation of the system easily interfaces with other construction materials and techniques to control water and air intrusion.

2. A flashing system as defined in claim 1 wherein said through wall rough opening means is a rough opening for a window.

3. A flashing system as defined in claim 1 wherein said through wall rough opening is a rough opening for a door.

4. A flashing system as defined in claim 1 wherein said through wall opening is a rough opening for a louver.

5. A flashing system as defined in claim 1 wherein said clay coated polyethylene sheet flashing material has a clay coating on both sides thereof and said attachment means comprises a preliminary coating of said elastomeric adhesive sealant on said areas of said rough opening members to be protected and bond with said clay coating on said polyethylene sheet flashing material followed by manual stapling for added securement.

6. A flashing system as defined in claim 1 wherein said clay coated polyethylene sheet flashing material is coated with clay on both sides thereof and is installed in said rough opening with said clay coating facing downwardly and outwardly to allow said elastomeric adhesive sealant to bond thereto and provide an effective seal when said termination accessory means is applied thereover.

7. A flashing system as defined in claim 1 wherein said termination accessory means comprises a single pre-molded unit dimensioned to conform to each of said rough opening base corners and includes a first frontal L-shaped portion formed by first horizontal and vertical leg portions for placement on said exterior sheathing of said rough opening means; each of said first horizontal and vertical leg portions having an integral, rearwardly extending portion perpendicular thereto for placement over the intersecting area of one of said vertical stud members and said horizontal base member of said rough opening with a second L-shaped portion having each of its legs attached to one of said rearwardly extending portions forming a corner end dam and whereby said single pre-molded molded unit cooperates with said sheet of clay coated polyethylene flashing material and said coating of elastomeric adhesive sealant to provide weather resistive protection for said rough opening base corner.

8. A flashing system as defined in claim 7 wherein each of said leg portions of said first and second L-shaped portions are of equal length and width respectively, said inwardly extending portions connecting said first and second L-shaped portion also of equal length and width thus permitting the same termination accessory unit to be inserted in either rough opening base corner merely by rotating it ninety degrees prior to insertion.

9. A flashing system as defined in claim 7 wherein one of said premolded termination accessory units is placed in each of said rough opening base corners to provide protection against water intrusion therethrough.

10. A pre-molded, elastomeric, flexible termination accessory unit for use in a flashing system comprising:

a first L-shaped frontal portion having a first vertical leg and a horizontal leg;

an integrally formed intermediate portion extending rearwardly and perpendicularly from each of said leg portions and forming a right angle at their point of attachment;

said integrally formed intermediate portions having a second L-shaped portion with one leg of said second L-shaped portion integrally depending from said integrally formed intermediate portions;

said legs of said second L-shaped portion forming a right angle at their points of attachment with said intermediate portions; and indicating means on said first L-shaped frontal portion for indicating proper orientation of said unit when used in a flashing system.

11. A pre-molded, elastomeric, flexible termination accessory unit as defined in claim 10 wherein said indicating means comprises an arrow located at an upper edge of each leg of said first L-shaped frontal portions to indicate proper orientation of said unit whereby rotation of said pre-molded unit until one of said arrows points vertically gives an indication for a first corner use while rotating said unit until said other arrow points vertically gives an indication for use in the opposite corner.

12. A pre-molded, elastomeric, flexible termination accessory unit as defined in claim 10 wherein said unit is available in a plurality of sizes to accommodate a variety of flashing system requirements.

13. A pre-molded, elastomeric, flexible termination accessory unit as defined in claim 10 wherein the material used in making said unit is a high performance elastomeric material.

14. A pre-molded, elastomeric, flexible termination accessory unit as defined in claim 10 wherein said second L-shaped portion is of significantly less dimensions than said first L-shaped portion.

15. A flashing system for preventing water and air intrusion at through wall penetrations of a building comprising:

throughwall opening means in a building structure including a sill member, a pair of spaced vertical studs forming jamb members attached to said sill member and a header member attached to upper ends of said stud members forming said throughwall opening;

attachment means comprising an elastomeric adhesive sealant applied to said rough opening members at specified locations; and flexible flashing means comprising a plurality of clay coated polyethylene sheet material pieces folded and secured to said rough opening by said attachment means and reinforcing means selectively applied to strength high stress areas; whereby said rough opening is provided with protection against water and air intrusion for a closure member when inserted in said rough opening.

16. A flashing system as defined in claim 15 wherein said attachment means comprises an elastomeric adhesive sealant which is applied in liquid form over said through wall opening members prior to placement of said flexible flashing means thereon.

17. A flashing system as defined in claim 15 wherein said plurality of clay coated polyethylene film pieces comprises a first piece installed on said sill member with upwardly turned portions onto each of said side stud members, followed by a piece of clay coated polyethylene film on each of said side stud members with an overlapping portion onto said sill flashing piece and said header member; and a fourth piece of clay coated polyethylene film installed over said header member with a downwardly turned portion overlapped each of said side stud pieces of clay coated polyethylene film; each of said four pieces having an integral lip portion to prevent inward flow of water and air into the building structure.

18. A flashing system as defined in claim 16 wherein said flexible flashing means comprises a first piece of clay coated polyethylene film material installed at said sill member;

a pair of termination accessories adhesively bonded to said sill piece of clay coated polyethylene film material by a layer of elastomeric adhesive sealant applied to each of the lower corner areas of said opening;

a first jamb piece of clay coated polyethylene film material applied to one of jamb members followed by a second piece of clay coated polyethylene material applied to said second jamb member with the lowermost end of each of said jamb pieces overlapping the upper edge of said termination accessories followed by a header piece of clay coated polyethylene film material placed over said header member with a downward turned overlapping portion extending over the upper ends of said jamb film pieces whereby said rough opening is completely flashed against water and air intrusion in preparation for the installation of a window, door, louver or other building component therein.

19. A flashing system as defined in claim 15 wherein said flexible flashing means comprises a polyethylene film material which is coated with clay on at least one side thereof whereby said elastomeric adhesive sealant readily bonds with the clay coating thereon.

* * * * *